United States Patent [19]

Freiberg

[11] Patent Number: 4,726,124

[45] Date of Patent: Feb. 23, 1988

[54] TEXTILE MACHINE HAVING CONTINUOUS CONVECTIVE HEAT TREATMENT

[75] Inventor: Helge Freiberg, Monchen-Gladbach, Fed. Rep. of Germany

[73] Assignee: A. Monforts GmbH & Co., Monchen-Gladbach, Fed. Rep. of Germany

[21] Appl. No.: 14,226

[22] Filed: Feb. 12, 1987

[30] Foreign Application Priority Data

Feb. 18, 1986 [DE] Fed. Rep. of Germany ..... 3605100

[51] Int. Cl.[4] ..... F26B 13/02

[52] U.S. Cl. ..... 34/79; 34/155; 34/158

[58] Field of Search ..... 34/155, 158, 79, 86

[56] References Cited

U.S. PATENT DOCUMENTS 3,706,445 12/1972 Gentry ..... 34/79
4,475,294 10/1984 Henricks ..... 34/86
4,516,332 5/1985 Takaoka et al. ..... 34/158

*Primary Examiner*—Larry I. Schwartz

*Attorney, Agent, or Firm*—Herbert L. Lerner; Laurence A. Greenberg

[57] ABSTRACT

A textile machine for continuously convectively heat treating a textile fabric web with ambient air, includes a loop for ambient air, a blower in the loop forcing the ambient air through the loop, an intake chamber upstream of the blower in the loop, a heat exchanger in the intake chamber for heating the ambient air, the heat exchanger having a hot side, a first section for preheating a first partial flow diverted from the ambient air containing harmful substances and a second section for heating a second partial flow diverted from the ambient air, a connecting conduit in the intake chamber receiving the first partial flow from the first section, a burner disposed inside the intake chamber receiving the first partial flow of the ambient air from the connecting conduit, a combustion chamber adjoining the burner in the intake chamber for thermal after-burning of the harmful substances at a given sufficient combustion temperature, another conduit for feeding heat liberated in the after-burning to the hot side of the heat exchanger, a bypass for adjusting the second partial flow, and a waste air conduit adjoining the heat exchanger and leading out of the machine.

5 Claims, 1 Drawing Figure

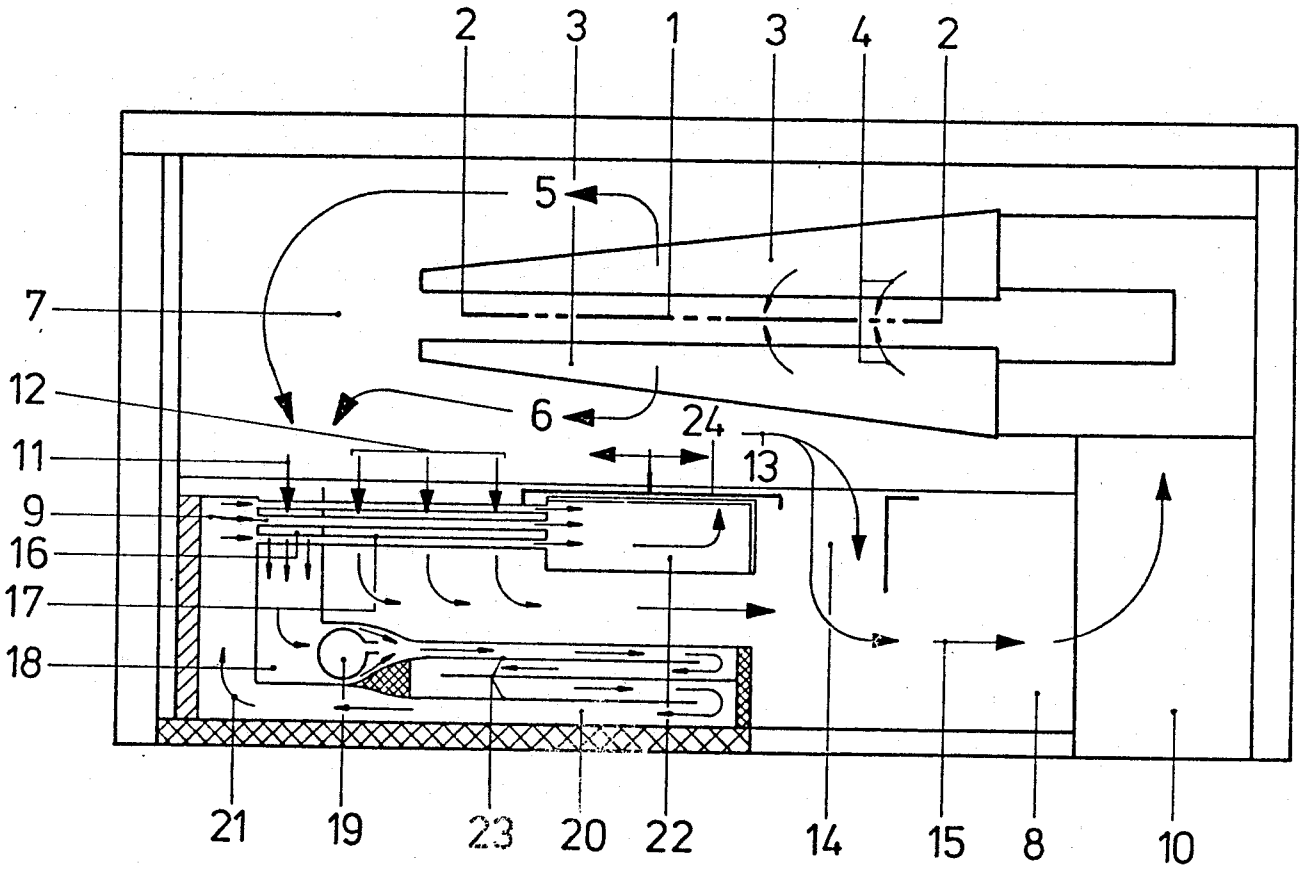
2
4
3
1
3
2
5
6
7
12
11
9
16
17
18
24
13
10
8
15
14
22
20
23
19
21

TEXTILE MACHINE HAVING CONTINUOUS CONVECTIVE HEAT TREATMENT

The invention relates to a textile machine having continuous convective heat treatment of a textile fabric web with ambient air forced through a loop by a blower and heated in a heat exchanger disposed in an intake chamber upstream of the blower, and an apparatus for thermal after-burning of entrained harmful substances associated with a first partial flow of the ambient air, heat liberated in the after-burning being fed to the hot side of the heat exchanger.

In many production processes, when hot air is supplied to goods, agents used in pretreatment, such as spinning oils, softeners, or dyes, are set free, they are mixed with lint and dust and they enter the outgoing air of the plant. Since these substances have an impact on the environment, at times to the point of damaging the environment because of their odor and color and because they settle out of the air, attempts are increasingly made to prevent the contamination of the air.

The waste air from a textile machine of the type described above can be cleaned by the after-burning of entrained harmful substances. In such thermal after burning systems, the waste air is heated to approximately 750 degrees C. The entrained harmful organic substances are substantially converted into carbon dioxide and water. The quantity of heat liberated in the thermal after-burning of the harmful substances can be used, for example, to heat the contents of an oil circulation vessel. The heated circulating oil can be used to act upon the heating side of a heat exchanger provided for heating of the ambient air flow of the particular textile machine. A disadvantage of such a system is that because of the cleaning of the exhaust gases, an oil circulation system which entails considerable expense, is absolutely necessary.

The heated gases of the thermal after-burning system could therefore be used for heating the ambient air of the associated textile machine. Such attempts have not yet proved to be sufficiently reliable in operation, because the temperatures required for after-burning of the waste air, in the order of magnitude of 750 degrees C., are far above the temperatures that are permissible in the handling of textiles, which are in the order of magnitude of 200 degrees C. Accordingly, either the thermal energy to be supplied to the after-burning system is too great for use in the ambient air system of the machine and can lead to overheating, or if the after-burning energy supplied is reduced, only an overly small portion of ambient air can be vented in the form of after-burned or cleaned waste air, with the result that the ambient air entrains too much harmful material and can soil the goods that are being treated.

It is accordingly an object of the invention to provide a a textile machine having continuous convective heat treatment, which overcomes the hereinafore-mentioned disadvantages of the heretofore-known devices of this general type and to integrate a thermal after-burning system into the associated textile machine in such a way that the thermal energy required for operating the after-burning system can be totally recycled for heating the ambient air flow of the machine and no additional thermal energy is needed to heat the incoming air flow.

With the foregoing and other objects in view there is provided, in accordance with the invention, a textile machine for continuously convectively heat treating a textile fabric web with ambient air, comprising a loop for ambient air, a blower in the loop forcing the ambient air through the loop, an intake chamber upstream of the blower in the loop, a heat exchanger in the intake chamber for heating the ambient air, the heat exchanger having a hot side, a first section for preheating a first partial flow diverted or branched-off from the ambient air containing harmful substances and a second section for heating a second partial flow diverted or branched-off from the ambient air, a connecting conduit in the intake chamber receiving the first partial flow from the first section, a burner disposed inside the intake chamber receiving the first partial flow of the ambient air from the connecting conduit, a combustion chamber adjoining the burner in the intake chamber for thermal after-burning of the harmful substances at a given sufficient combustion temperature, means for feeding heat liberated or released in the after-burning to the hot side of the heat exchanger, a bypass for adjusting the second partial flow, and a waste air conduit adjoining the heat exchanger and leading out of the machine.

In accordance with the invention, the partial flow of the ambient air which is to be supplied to the thermal afterburning system, is first heated prior to the after-burning, by the waste air of the after-burning system. Therefore, the after-burning system can be operated with substantially less energy than in the case where this partial flow is delivered directly to the burner. The reduction in the energy supplied, at the same time represents a reduction in the waste heat produced in the after-burning. The waste heat can therefore substantially be consumed in the heat exchanger, which is advantageously also disposed in the intake chamber of the textile machine. In accordance with the invention this heat exchanger is intended to include a first section for preheating the first partial flow of ambient air to be supplied for the after-burning and a second section for heating a second partial flow of the ambient air of the machine.

The various component units according to the invention are suitably constructed in such a manner that the second ambient air flow is to be heated to a maximum usable temperature in the machine with maximum energy consumption. In the event that the maximum temperature or the maximum energy output of the ambient air flow of the machine is not desired, then a portion of the cooled ambient air can be sent through a bypass around the heat exchanger and then reunited with the heated second ambient air flow and accelerated by the blower. The temperatures of the first partial flow to be supplied to the waste air, of the second partial flow of ambient air to be heated and of the bypass, can be adjusted by predetermining the cross sections of the individual partial ambient air flows and of the bypass, in such a way that a first ambient air flow adapted to requirements for removing the incident harmful substances and a particular desired operating temperature in the textile machine, can be attained with the minimum possible energy consumption in the after-burning system.

It is preferable for the heat exchanger and the burner to be in the form of component units capable of directly encompassing the full width of the partial flows, as far as possible, so that the individual partial flows of ambient air can flow on a broad front through the heat exchanger and the burner, that is over the entire appropriate width over the length of the machine, as measured in the direction of fabric travel.

In accordance with another feature of the invention, the combustion chamber downstream of the burner includes a labyrinthine dwell section for the complete after-burning of the harmful substances.

In accordance with a further feature of the invention, the bypass bypasses the heat exchanger, the second partial flow of the ambient air flowing from the second section of the heat exchanger through the bypass carries ambient air not delivered for after-burning, and including means upstream of the blower for reuniting the partial flows into an ambient air flow in the blower, a single cover plate, and means for displacing the cover plate for adjusting the first and second partial flows and establishing a predetermined temperature in the ambient air flow reunited in the blower.

In accordance with an added feature of the invention, the heat exchanger includes coiled pipes.

In accordance with a concomitant feature of the invention, the burner is a gas burner or a line burner and a line burner operated with gas, is therefore preferably used as the burner.

Other features which are considered as characteristic for the invention are set forth in the appended claims.

Although the invention is illustrated and described herein as embodied in a textile machine having continuous convective heat treatment, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawing.

The single FIGURE of the drawing is a diagrammatic, vertical sectional view of an embodiment of the textile machine according to the invention. Referring now to the FIGURE of the drawing in detail, it is seen that the vertical section of the drawing is taken across the transporting direction through a tentering or stretching frame. In the illustrated embodiment of the tentering frame, a fabric web 1, which is preferably held or tentered at the longitudinal edges 2 thereof, is transported in a transporting direction perpendicular to the plane of the drawing through and between blower or nozzle boxes 3 disposed above and below the path of the web. The blower boxes 3 have nozzles from which heated treatment air is blown onto the surface of the web 1 in the direction of an arrow 4. The air is reflected by the web 1 and proceeds in the direction of arrows 5 and 6 through return conduits provided between the blower boxes 3, into a return chamber 7 of the machine and from there the air is delivered to an intake or suction chamber 8, having a heat exchanger 9 of a blower 10. The blower 10 pumps the air back to the blower boxes 3.

At the fabric web 1, the ambient air which is circulated in a loop as described above, picks up various harmful substances, such as fumes from spinning oil and brighteners.

For this reason, a partial flow of the ambient air is to be continuously diverted and vented from the building as waste air after being cleaned. In the tentering frame of the illustrated embodiment, the ambient air is divided upstream of the heat exchanger 9 into two or three partial flows 11, 12 and optionally 13. The first and second partial flows 11, 12 pass through the heat exchanger 9, while the third partial flow is to be delivered to the intake chamber 8 through a bypass 14, which may be opened to a variable extent, thus bypassing the heat exchanger 9. The partial flows 12 and 13 are reunited in the intake chamber and are once again accelerated as ambient air 15 in the blower 10.

The heat exchanger of the illustrated embodiment, which is identified as a whole by reference numeral 9, includes a first section 16 for preheating the first partial flow 11 that becomes part of the waste air and a second section 17 for preheating the partial flow 12 of the ambient air. The first partial flow 11 of the ambient air that is preheated in the first section 16 of the heat exchanger 9 travels through a connecting conduit 18 to a line burner 19, which extends over the entire width of the ambient air flow, as measured in the fabric transport direction, and has an adjoining combustion chamber 20. The combustion chamber 20 in the illustrated embodiment is elongated in labyrinth fashion, that is the burner 19 is adjoins a meandering dwell or delay section serving as the combustion chamber 20, in which the harmful substances collected in the ambient air are gradually burned.

Waste air 21 cleaned in this manner by thermal after burning or post combustion has a relatively high temperature, on the order of 750 degrees C. This high thermal content is utilized in the heat exchanger 9 for preheating the first and second partial flows of ambient air in the first section 16 and the second section 17. After passing through the two sections 16 and 17 of the heat exchanger 9, the cleaned waste air enters a waste air conduit 22 and from there it travels to the chimney of the plant, possibly by means of a fan. If the heat exchanger is constructed in the form of coiled pipes, then the waste air arriving from the burner should be conducted through the pipes of the heat exchanger.

The above-described integrated after-burning system formed of the burner 19 and the combustion chamber 20 is installed in the intake chamber 8 of each section of a tentering frame. The burner 19 is regulated in accordance with the type and density of the harmful substances to be burned. The required dwell or delay time for after-burning of the harmful substances is obtained by conducting the air heated in the burner 19 back and forth in meandering fashion with deflecting plates 23. The waste air, which is still hot after leaving the combustion chamber 20, is carried to the heat exchanger 9 by the connecting conduit 18. In the heat exchanger, the air cleaned by burning is cooled by the action of the first and second partial flows of ambient air. This type of after-burning system with an adjoining heat exchanger is necessary in each section of a tentering frame. However, the waste air conduit 22 can extend through the entire machine as a collecting conduit, so that as a rule only one waste air fan is needed per machine for venting the air cleaned by burning, to the outside air.

The portion of the ambient air 15 not used as waste air is carried with the partial flow 12 through the second section 17 of the heat exchanger 9. The important factor in this case is that the hot waste air leaving the burner 19 or the combustion chamber 20 has already cooled down somewhat in the second section 17, by preheating the first partial flow 11 of the ambient air. The ambient air of the second partial flow 12 remaining in the machine is thus not heated excessively, so that this partial ambient air flow can be delivered to the blower 10 and to the blower boxes 3.

The temperature of the ambient air 15 can be regulated very accurately, in the apparatus described above. In the illustrated embodiment, depending on the thermal requirement, a portion of the air-to-air heat exchanger 9 is covered by a plate 24, which is motor-driven in the direction of an arrow, so that a portion of the heat exchanger can no longer be acted upon by the ambient air 15 returning from the fabric web. At the same time, the bypass 14 for the third partial flow 13 is opened for the ambient air. Downstream of the bypass 14, the heated second partial ambient air flow 12 and the unheated third partial ambient air flow 13 are reunited and re-mixed as ambient air 15 in the intake chamber 8. The second partial flow can be heated to a greater or lesser degree, depending on the position of the cover plate 24 and thus depending on the quantity of the ambient air flow flowing through the second section 17 of the heat exchanger. The temperature of the ambient air 15 can thus be adjusted precisely to a predetermined value by adapting the flow rates of the second and third partial flows 12 and 13. As a rule, a gas burner is provided as the burner 19. Accordingly, the machine and the ambient air 15 circulated in the machine are heated separately in each section by a burner that generates a temperature that is inherently too high for the operation of the machine, but the waste heat thereof is first utilized in the first heat exchanger section 16 for heating the waste air processed in the burner 19, so that the adjoining heat exchanger section 17 has a temperature that is still acceptable for heating the ambient air of the machine.

The foregoing is a description corresponding in substance to German Application No. P 36 05 100.4, dated Feb. 18, 1986, the International priority of which is being claimed for the instant application and which is hereby made part of this application. Any material discrepancies between the foregoing specification and the aforementioned corresponding German application are to be resolved in favor of the latter.

I claim:

1. Textile machine for continuously convectively heat treating a textile fabric web with ambient air, comprising a loop for ambient air, a blower in said loop forcing the ambient air through said loop, an intake chamber upstream of said blower in said loop, a heat exchanger in said intake chamber for heating the ambient air, said heat exchanger having a hot side, a first section for preheating a first partial flow diverted from the ambient air containing harmful substances and a second section for heating a second partial flow diverted from the ambient air, a connecting conduit in said intake chamber receiving the first partial flow from said first section, a burner disposed inside said intake chamber receiving the first partial flow of the ambient air from said connecting conduit, a combustion chamber adjoining said burner in said intake chamber for thermal after-burning of the harmful substances at a given sufficient combustion temperature, means for feeding heat liberated in the after-burning to said hot side of said heat exchanger, a bypass bypassing said heat exchanger for adjusting said second partial flow, the second partial flow of the ambient air flowing from said second section of said heat exchanger through said bypass carrying ambient air not delivered for after-burning, means upstream of said blower for reuniting the partial flows into an ambient air flow in said blower, a single cover plate, means for displacing said cover plate for adjusting the first and second partial flows and establishing a predetermined temperature in the ambient air flow reunited in said blower, and a waste air conduit adjoining said heat exchanger and leading out of the machine.

2. Textile machine according to claim 1, wherein said heat exchanger includes coiled pipes.

3. Textile machine according to claim 1, wherein said burner is a gas burner.

4. Textile machine according to claim 1, wherein said burner is a line burner.

5. Textile machine according to claim 1, wherein said combustion chamber downstream of said burner includes a labyrinthine dwell section for the complete after-burning of the harmful substances.

* * * * *